US008563842B2

(12) United States Patent
Kim et al.

(10) Patent No.: US 8,563,842 B2
(45) **Date of Patent: *Oct. 22, 2013**

(54) METHOD AND APPARATUS FOR SEPARATING MUSICAL SOUND SOURCE USING TIME AND FREQUENCY CHARACTERISTICS

(75) Inventors: Min Je Kim, Daejeon (KR); In Seon Jang, Daejeon (KR); Kyeong Ok Kang, Daejeon (KR); Seung Jin Choi, Gyeongsangbuk-do (KR); Ji Ho Yoo, Seoul (KR); Jin Woong Kim, Daejeon (KR)

(73) Assignees: Electronics and Telecommunications Research Institute, Daejeon (KR); Postech Academy-Industry Foundation, Pohang (KR)

( * ) Notice: Subject to any disclaimer, the term of this patent is extended or adjusted under 35 U.S.C. 154(b) by 288 days.

This patent is subject to a terminal disclaimer.

(21) Appl. No.: 13/076,630

(22) Filed: Mar. 31, 2011

(65) Prior Publication Data

US 2012/0291611 A1 Nov. 22, 2012

(30) Foreign Application Priority Data

Sep. 27, 2010 (KR) ..... 10-2010-0093443
Dec. 17, 2010 (KR) ..... 10-2010-0130223

(51) Int. Cl.
*G10H 1/00* (2006.01)

(52) U.S. Cl.
USPC ..... 84/615; 84/635; 702/190; 702/196; 704/200

(58) Field of Classification Search
USPC ..... 84/615, 617, 618, 635; 704/200; 702/190, 196
See application file for complete search history.

(56) References Cited

U.S. PATENT DOCUMENTS

| | | | | |
|---|---|---|---|---|
| 7,672,834 | B2 * | 3/2010 | Smaragdis | 704/204 |
| 7,698,143 | B2 * | 4/2010 | Ramakrishnan et al. | 704/500 |
| 7,797,153 | B2 * | 9/2010 | Hiroe | 704/211 |
| 8,015,003 | B2 * | 9/2011 | Wilson et al. | 704/226 |
| 8,080,724 | B2 * | 12/2011 | Kim et al. | 84/615 |

(Continued)

FOREIGN PATENT DOCUMENTS

| | | |
|---|---|---|
| KR | 10-0826659 | 4/2008 |
| KR | 10-2009-0122218 | 10/2009 |
| KR | 10-2009-0122217 | 12/2009 |

OTHER PUBLICATIONS

Minje Kim et al. "Blind Rythmic Source Separation", Published Nov. 2009 in the Acoustical Society of Korean Journal, vol. 28, No. 8, pp. 697-705.

*Primary Examiner* — David S. Warren
(74) *Attorney, Agent, or Firm* — Staas & Halsey LLP

(57) ABSTRACT

A method and apparatus for separating and extracting main sound sources from a mixed musical sound signal are provided. A musical sound source separation apparatus may include an prior information signal compressor to compress an prior information signal including a characteristic of a predetermined sound source, a mixed signal divider to divide a mixed signal including a plurality of sound sources into a plurality of segments, a Nonnegative Matrix Partial Co-Factorization (NMPCF) analyzer to acquire common information shared by the plurality of segments, by applying an NMPCF algorithm to the prior information signal, and a target musical instrument signal separator to separate a target musical instrument signal corresponding to the predetermined sound source from the mixed signal, based on the common information.

18 Claims, 6 Drawing Sheets

(56) References Cited

U.S. PATENT DOCUMENTS

| | | | | |
|---|---|---|---|---|
| 8,112,272 | B2 * | 2/2012 | Nagahama et al. | 704/226 |
| 8,340,943 | B2 * | 12/2012 | Kim et al. | 702/190 |
| 2005/0222840 | A1 * | 10/2005 | Smaragdis | 704/204 |
| 2007/0185705 | A1 * | 8/2007 | Hiroe | 704/200 |
| 2009/0132245 | A1 * | 5/2009 | Wilson et al. | 704/226 |
| 2009/0234901 | A1 * | 9/2009 | Cichocki et al. | 708/320 |
| 2011/0054848 | A1 * | 3/2011 | Kim et al. | 702/190 |
| 2011/0058685 | A1 * | 3/2011 | Sagayama et al. | 381/98 |
| 2011/0061516 | A1 * | 3/2011 | Kim et al. | 84/625 |
| 2011/0311060 | A1 * | 12/2011 | Kim et al. | 381/17 |
| 2012/0095729 | A1 * | 4/2012 | Kim et al. | 702/190 |
| 2012/0291611 | A1 * | 11/2012 | Kim et al. | 84/615 |

* cited by examiner

METHOD AND APPARATUS FOR SEPARATING MUSICAL SOUND SOURCE USING TIME AND FREQUENCY CHARACTERISTICS

CROSS-REFERENCE TO RELATED APPLICATIONS

This application claims the benefit of Korean Patent Application No. 10-2010-0093443 and of Korean Patent Application No. 10-2010-0130223, respectively filed on Sep. 27, 2010 and Dec. 17, 2010, in the Korean Intellectual Property Office, the disclosures of which are incorporated herein by reference.

BACKGROUND

1. Field

Example embodiments of the following description relate to a musical sound source separation method, and more particularly, to an apparatus and method for efficiently separating only a signal of a target sound source from a mixed signal using both a time characteristic and a frequency characteristic of the target sound source.

2. Description of the Related Art

Due to development of technologies, methods for separating a predetermined sound source from a mixed signal where various sound sources are recorded together have been developed.

However, a conventional sound source separation technology separates a sound source using a statistical characteristic of the sound source, based on a model of an environment where signals are mixed. Accordingly, the conventional sound source separation technology requires a number of mixed signals corresponding to a number of sound sources to be separated.

Accordingly, there is a desire for a method that may separate a predetermined sound source from a musical sound signal where a number of sound sources in the musical sound signal is greater than a number of mixed signals to be acquired, and may prevent information of different sound sources from being mixed even when sound sources are separated using location information.

SUMMARY

According to example embodiments, there may be provided a musical sound source separation apparatus that may simultaneously perform an operation of distinguishing a target sound source from other sound sources in a mixed signal when there is information of a sound source played by only a predetermined musical instrument, and an operation of deriving a characteristic of the target sound source from the mixed signal and reconfiguring the target sound source, so that sound sources in the mixed signal may be more efficiently separated.

According to example embodiments, there may be also provided a musical sound source separation apparatus that may apply overlapping windows during separating of sound sources, to prevent a user from feeling heterogeneity between segments during playback of a target sound source, when the separated target sound source includes different error signals for each of the segments.

The foregoing and/or other aspects are achieved by providing a musical sound source separation apparatus including an prior information signal compressor to compress an prior information signal including a characteristic of a predetermined sound source, a mixed signal divider to divide a mixed signal into a plurality of segments, the mixed signal including a plurality of sound sources, a Nonnegative Matrix Partial Co-Factorization (NMPCF) analyzer to acquire common information by applying an NMPCF algorithm to the prior information signal, and the mixed signal, the common information being shared by the plurality of segments, and a target musical instrument signal separator to separate a target musical instrument signal corresponding to the predetermined sound source from the mixed signal, based on the common information.

The mixed signal divider may include a segment divider to divide the mixed signal into the plurality of segments, a first window applying unit to apply overlapping windows to the mixed signal divided into the plurality of segments, and a time-frequency domain transformer to transform the mixed signal divided into the plurality of segments into a time-frequency domain signal, and to provide the NMPCF analyzer with the time-frequency domain signal.

The segment divider may divide the mixed signal into the plurality of segments so that the plurality of segments may partially overlap each other.

The first window applying unit of the musical sound source separation apparatus may select forms of the overlapping windows, so that a sum of windows applied to an area where the plurality of segments partially overlap each other may be "1".

The foregoing and/or other aspects are achieved by providing a musical sound source separation method including compressing an prior information signal including a characteristic of a predetermined sound source, dividing a mixed signal into a plurality of segments, the mixed signal including a plurality of sound sources, acquiring common information by applying an NMPCF algorithm to the prior information signal, and the mixed signal, the common information being shared by the plurality of segments, and separating a target musical instrument signal corresponding to the predetermined sound source from the mixed signal, based on the common information.

Additional aspects, features, and/or advantages of example embodiments will be set forth in part in the description which follows and, in part, will be apparent from the description, or may be learned by practice of the disclosure.

According to example embodiments, when there is sound source information including only a predetermined sound source, a mixed signal may be reconfigured with a target sound source and other sound sources, by directly using the sound source information and, at the same time, by using a characteristic of a sound source that is periodically repeated, and thus it is possible to more efficiently separate the sound sources included in the mixed signal.

Additionally, according to example embodiments, it is possible to apply overlapping windows during separating of sound sources, thereby preventing a user from feeling heterogeneity between segments during playback of a target sound source, when the separated target sound source includes different error signals for each of the segments.

BRIEF DESCRIPTION OF THE DRAWINGS

These and/or other aspects and advantages will become apparent and more readily appreciated from the following description of the example embodiments, taken in conjunction with the accompanying drawings of which.

DETAILED DESCRIPTION

Figure 1:
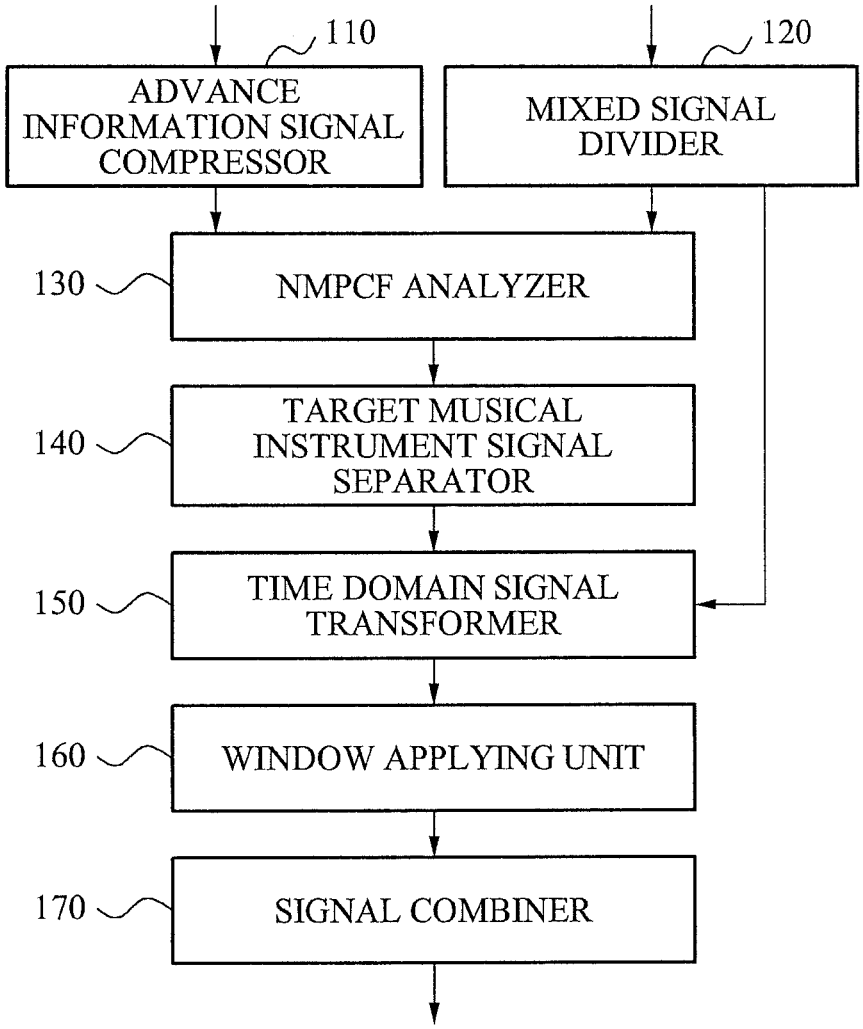
FIG. 1 illustrates a block diagram of a configuration of a musical sound source separation apparatus according to example embodiments.

Reference will now be made in detail to example embodiments, examples of which are illustrated in the accompanying drawings, wherein like reference numerals refer to the like elements throughout. Example embodiments are described below to explain the present disclosure by referring to the figures.

FIG. 1 illustrates a block diagram of a configuration of a musical sound source separation apparatus according to example embodiments.

Referring to FIG. 1, the musical sound source separation apparatus may include an prior information signal compressor 110, a mixed signal divider 120, a Nonnegative Matrix Partial Co-Factorization (NMPCF) analyzer 130, a target musical instrument signal separator 140, a time domain signal transformer 150, a window applying unit 160, and a signal combiner 170.

The prior information signal compressor 110 may compress an prior information signal including a characteristic of a predetermined sound source, and may transmit the compressed prior information signal to the NMPCF analyzer 130.

Here, since the prior information signal includes all various characteristics of the predetermined sound source, a considerable amount of data may exist. Accordingly, the prior information signal compressor 110 may compress an prior information signal, and may reduce a size of the prior information signal, thereby reducing an amount of data of a signal used to separate sound sources.

The prior information signal compressor 110 may compress the prior information signal, so that characteristics required to separate the predetermined sound source may remain even after compression.

A configuration and an operation of the prior information signal compressor 110 will be further described with reference to FIG. 2 below.

The mixed signal divider 120 may divide a mixed signal into a plurality of segments, and may transmit the plurality of segments to the NMPCF analyzer 130. Here, the mixed signal may include a plurality of sound sources.

A configuration and an operation of the mixed signal divider 120 will be further described with reference to FIG. 3 below.

The NMPCF analyzer 130 may acquire common information by applying an NMPCF algorithm to the mixed signal divided by the mixed signal divider 120 and the prior information signal compressed by the prior information signal compressor 110. Here, the common information may be shared by the plurality of segments, and may correspond to a plurality of entity matrices.

Here, the entity matrix $A^{(l)}$ used to separate the single segment may be divided into a common element $A^C$ shared by a plurality of input matrices, and an element $A_I^{(l)}$ existing in each of the input matrices. When an independent element does not exist in a prior information signal $X^{(l)}$, "$A^{(l)}=A^C$" may be satisfied. Additionally, when an entity matrix $A^{(l)}$ used to separate an prior information signal $X^{(1)}$ includes only a target sound source to be separated, the entity matrix $A^{(1)}$ may be formed of only the common element $A^C$, thereby satisfying "$A^{(1)}=A^C$".

Additionally, the NMPCF analyzer 130 may express the prior information signal $X^{(l)}$ using the following Equation 1 as a target function to be optimized.

$$\mathcal{J}_{NMPCF} = \sum_{l=1}^{L} \lambda_l \|X^{(l)} - A_C S_C^{(l)} - A_I^{(l)} S_I^{(l)}\|_F^2 + \gamma \left\{ \sum_{l=1}^{L} \|A^{(l)}\|_F^2 \right\} \quad \text{[Equation 1]}$$

In Equation 1, L denotes a number of input matrices including an prior information input matrix $X^{(1)}$, $\lambda_l$ denotes a degree of an influence of restoration of a predetermined input matrix on the target function to be optimized, and $\gamma$ denotes a parameter used to adjust a regularization level. Additionally, $A_C$ denotes a matrix of common frequency components shared by all segments, and $A_1^{(l)}$ denotes a matrix of different frequency components for each segment. Furthermore, $S_C^{(l)}$ denotes a time-related information matrix corresponding to $A_C$, and $S_1^{(l)}$ denotes a time-related information matrix corresponding to $A_I^{(l)}$.

Here, when the entity matrix $A^{(1)}$ includes only a target sound source to be separated, both the matrices $A_I^{(l)}$ and $S_I^{(l)}$ may be null matrices.

Additionally, the NMPCF analyzer 130 may update the entity matrices $A_C$, $A_I^{(l)}$, and $S_I^{(l)}$ by applying the entity matrices $A_C$, $A_I^{(l)}$, and $S_I^{(l)}$ to Equation 2, based on the NMPCF algorithm, to acquire entity matrices $A_C$, $A_I^{(l)}$, and $S_I^{(l)}$ that may minimize the target function of Equation 1.

$$S^{(l)} \leftarrow S^{(l)} \odot \left( \frac{A^{(l)\top} X^{(l)}}{A^{(l)\top} A^{(l)} S^{(l)}} \right)^{\eta}, \quad \text{[Equation 2]}$$

$$A_C \leftarrow A_C \odot \left( \frac{\sum_l \lambda_l X^{(l)} S_C^{(l)\top}}{\sum_l \lambda_l A^{(l)} S^{(l)} S_C^{(l)\top} + \gamma L A_C} \right)^{\eta},$$

$$A_I^{(l)} \leftarrow A_I^{(l)} \odot \left( \frac{\lambda_l X^{(l)} S_I^{(l)\top}}{\lambda_l A^{(l)} S^{(l)} S_I^{(l)\top} + \gamma A_I^{(l)}} \right)^{\eta},$$

In Equation 2, $(\,)^{\eta}$ denotes a value of an element unit square of a matrix that is limited to "0" to "1", and may be a parameter to adjust a updating speed.

The NMPCF analyzer 130 may initialize the entity matrices $A_C$, $A_I^{(l)}$, $S_C^{(l)}$, and $S_I^{(l)}$ using a real number, not a negative number, based on the NMPCF algorithm, and may update the entity matrices $A_C$, $A_I^{(l)}$, $S_C^{(l)}$, and $S_I^{(l)}$ using Equation 2, until the entity matrices $A_C$, $A_I^{(l)}$, $S_C^{(l)}$, and $S_I^{(l)}$ are converged to a constant value.

Here, a multiplicative characteristic of Equation 2 may not change signs of elements included in the entity matrices.

The NMPCF analyzer 130 may acquire the common information shared by the plurality of segments based on the NMPCF algorithm, as described above. Here, the common information may correspond to information of a target sound source that repeatedly appears while maintaining its frequency characteristic, among sound sources appearing through segments $X^{(2)}$ through $X^{(L)}$ of a mixed signal. Additionally, the common information may correspond to information of a sound source having a similar frequency characteristic to the prior information signal $X^{(1)}$.

The target musical instrument signal separator 140 may separate a target musical instrument signal corresponding to the predetermined sound source from the mixed signal, based on the common information obtained by the NMPCF analyzer 130. Here, the target musical instrument signal separated by the target musical instrument signal separator 140 may be in a time-frequency domain.

Specifically, the target musical instrument signal separator 140 may calculate a dot product between entity matrices corresponding to common information, and may separate a target musical instrument signal corresponding to a predetermined sound source from the mixed signal. Here, the target musical instrument signal may have a similar frequency characteristic to the prior information input signal, and may include a sound source repeatedly appearing through a plurality of segments.

For example, the target musical instrument signal separator 140 may calculate a dot product between entity matrices $A_C$ and $S_{C(1)}$, may separate a target musical instrument signal from a mixed signal divided into segments, and may derive the separated target musical instrument signal as an approximation signal $A_C S_C^{(1)}$ of a magnitude expression in a time-frequency domain. Here, the target musical instrument signal separator 140 may determine the approximation signal $A_C S_C^{(1)}$ in which a segment index 1 is "1", as an prior information input signal that does not need to be restored, and the approximation signal $A_C S_C^{(1)}$ may not be included in the approximation signal $A_C S_C^{(1)}$.

The time domain signal transformer 150 may transform the target musical instrument signal separated by the target musical instrument signal separator 140 into a time domain signal, and may generate estimation signals for each of the segments. Here, the estimation signals may be obtained by separating the target musical instrument signal.

For example, the time domain signal transformer 150 may again transform the approximation signal $A_C S_C^{(1)}$ into a time domain signal for each of the segments, and may derive estimated signals $y_2, \ldots,$ and $y_L$ in the time domain for each of the segments. Here, the time domain signal transformer 150 may utilize phase information $\Phi_2, \Phi_3, \ldots,$ and $\Phi_L$ for each of the segments that is derived by the mixed signal divider 120.

The window applying unit 160 may apply overlapping windows to the estimated signals generated by the time domain signal transformer 150. Here, the window applying unit 160 may correct different error signals for each of the segments by applying the overlapping windows to the estimated signals. Additionally, the window applying unit 160 may not be operated depending on example embodiments. When the window applying unit 160 is not operated, the estimated signals generated by the time domain signal transformer 150 may be transmitted directly to the signal combiner 170.

The signal combiner 170 may combine the estimated signals received directly from the time domain signal transformer 150, or the estimated signals passing through the window applying unit 160, and may generate a composite estimated signal.

Specifically, the signal combiner 170 may connect restoration signals in the time domain for each of the segments, to obtain a composite estimated signal "y". Here, the signal combiner 170 may connect the segments through an overlapping, depending on whether the window applying unit 160 is applied, and may correct different error signals for each of the segments.

Figure 2:
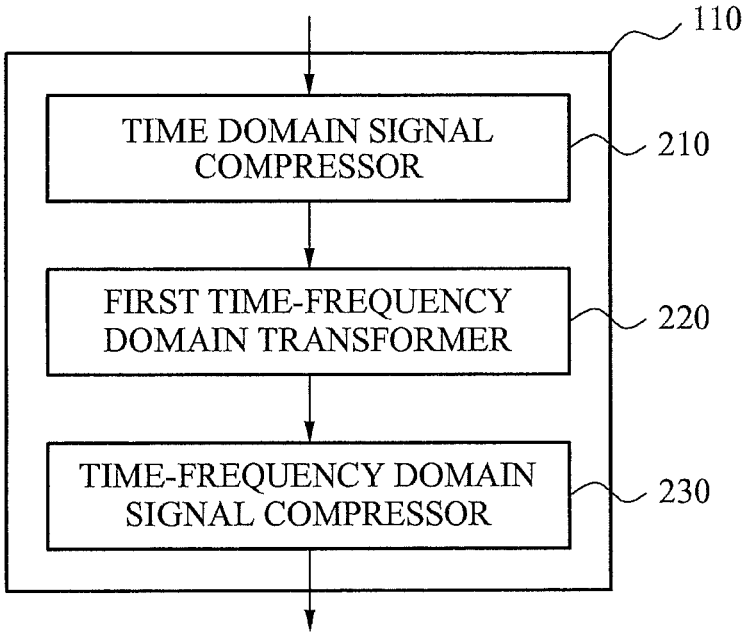
FIG. 2 illustrates a block diagram of a configuration of an prior information signal compressor of FIG. 1.

FIG. 2 illustrates a block diagram of the configuration of the prior information signal compressor 110.

Referring to FIG. 2, the prior information signal compressor 110 may include a time domain signal compressor 210, a first time-frequency domain transformer 220, and a time-frequency domain signal compressor 230.

The time domain signal compressor 210 may compress an prior information signal in a time domain. Specifically, the time domain signal compressor 210 may compress an prior information signal $x_1$ in a time domain while maintaining characteristics for separation of sound sources, to obtain the compressed prior information signal $x_1'$ in the time domain. Here, the prior information signal $x_1$ may include only a predetermined sound source to be separated.

The first time-frequency domain transformer 220 may transform the prior information signal in the time domain compressed by the time domain signal compressor 210 into an prior information signal in a time-frequency domain. Specifically, the first time-frequency domain transformer 220 may transform the compressed prior information signal $x_1'$ into an prior information signal $X_1$ in a time-frequency domain, using various time-frequency domain transform schemes, for example, a short-time Fourier transform (STFT) scheme.

The time-frequency domain signal compressor 230 may compress the prior information signal in the time-frequency domain transformed by the first time-frequency domain transformer 220, and may provide the NMPCF analyzer 130 with the compressed prior information signal in the time-frequency domain. Specifically, the time-frequency domain signal compressor 230 may compress the prior information signal $X_1$ while maintaining characteristics for separation of sound sources, to obtain the compressed prior information signal $X_1'$ in the time-frequency domain.

Here, the time domain signal compressor 210, and the time-frequency domain signal compressor 230 may not be used depending on example embodiments.

Figure 3:
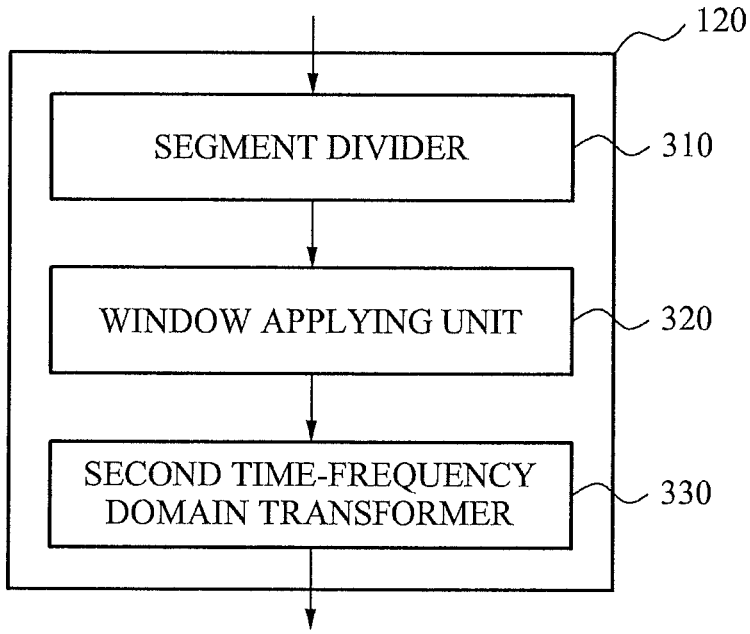
FIG. 3 illustrates a block diagram of a configuration of a mixed signal divider of FIG. 1.

FIG. 3 illustrates a block diagram of the configuration of the mixed signal divider 120.

Referring to FIG. 3, the mixed signal divider 120 may include a segment divider 310, a window applying unit 320, and a second time-frequency domain transformer 330.

The segment divider 310 may divide the mixed signal into a plurality of segments. Specifically, the segment divider 310 may divide a mixed signal "x" into a plurality of segments "$x_2$" through "$x_L$" that each have a predetermined length. Here, the segment divider 310 may divide the mixed signal so that the plurality of segments may partially overlap each other, depending on whether the window applying unit 160 or the window applying unit 320 is used.

The window applying unit 320 may apply overlapping windows to the mixed signal divided into the plurality of segments by the segment divider 310.

Here, when the target musical instrument signal separated by the target musical instrument signal separator 140 includes different error signals for each of the segments, the window applying units 320 and 160 may apply overlapping windows, to prevent a user from feeling heterogeneity between the segments during playback of the estimated signals combined by the signal combiner 170.

Depending on the example embodiments, either the window applying unit 320 or the window applying unit 160 may be operated. The window applying units 320 and 160 may select forms of the overlapping windows, so that a sum of windows applied to an area where the plurality of segments partially overlap each other may be "1".

The second time-frequency domain transformer 330 may transform the mixed signal divided by the segment divider 310 into a time-frequency domain signal, and may provide the NMPCF analyzer 130 with the time-frequency domain signal.

Specifically, the second time-frequency domain transformer 330 may transform the mixed signal passing through the segment divider 310 and the window applying unit 320, into time-frequency domain mixed signal of segments $X^{(2)}$ through $X^{(L)}$. Here, the second time-frequency domain transformer 330 may use one of various time-frequency domain transform schemes to transform the mixed signal into a time-frequency domain mixed signal of segments. Additionally, the second time-frequency domain transformer 330 may extract phase information $\Phi_2$, $\Phi_3$, . . . , and $\Phi_L$, from the plurality of segments "$x_2$" through "$x_L$" of the mixed signal "x", and may transmit the extracted phase information $\Phi_2$, $\Phi_3$, . . . , and $\Phi_L$ to the time domain signal transformer 150.

Figure 4:
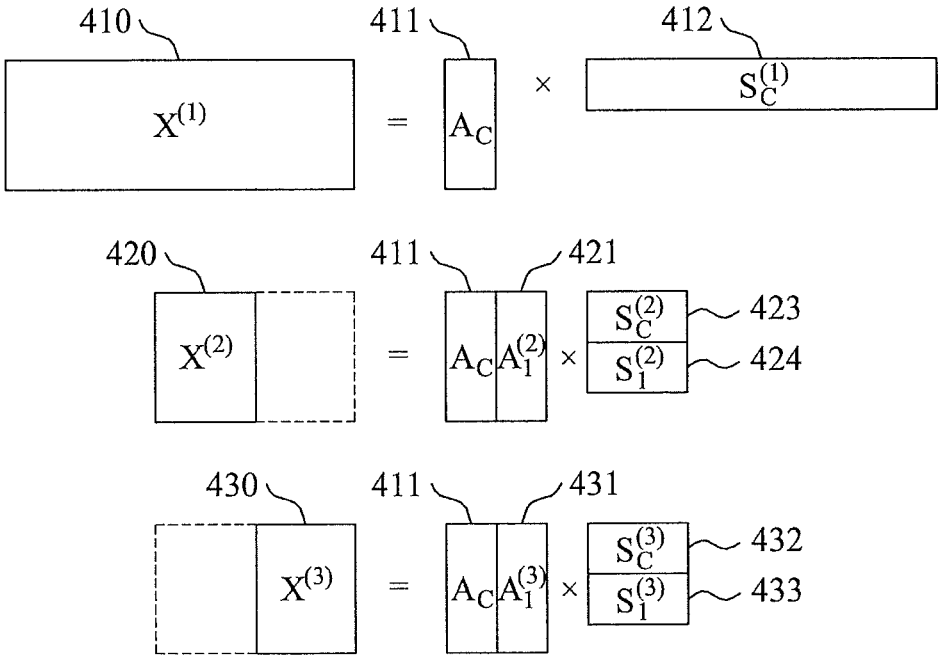
FIG. 4 illustrates a diagram of examples of segments input to a Nonnegative Matrix Partial Co-Factorization (NMPCF) analyzer when a window applying unit of the musical sound source separation apparatus is not operated according to example embodiments.

FIG. 4 illustrates a diagram of examples of segments input to the NMPCF analyzer 130 when the window applying unit 160 is not operated.

Specifically, FIG. 4 illustrates an example in which a mixed signal is divided into two segments $X^{(2)}$, and $X^{(3)}$.

In this example, a first segment $X^{(1)}$ 410 input to the NMPCF analyzer 130 may be an absolute value of the time-frequency domain of the prior information signal that is received from the prior information signal compressor 110. As illustrated in FIG. 4, the first segment $X^{(1)}$ 410 may be transformed to a dot product between a common frequency matrix $A_C$ 411 and a time-related information matrix $S_C^{(l)}$ 412 corresponding to the common frequency matrix $A_C$ 411. The common frequency matrix $A_C$ 411 may be a matrix of common frequency components shared by the first segment $X^{(1)}$ 410, a second segment $X^{(2)}$ 420, and a third segment $X^{(3)}$ 430.

Additionally, the second segment $X^{(2)}$ 420 and the third segment $X^{(3)}$ 430 may be obtained by dividing the mixed signal, and may be received by the NMPCF analyzer 130. The second segment $X^{(2)}$ 420 and the third segment $X^{(3)}$ 430 may include a common component, and their respective non-target sound source information.

Specifically, the common component of the second segment $X^{(2)}$ 420 may be transformed to a dot product between the common frequency matrix $A_C$ 411 and a time-related information matrix $S_C^{(2)}$ 423 corresponding to the common frequency matrix $A_C$ 411. Additionally, the non-target sound source information included in only the second segment $X^{(2)}$ 420 may be transformed to a dot product between a unique frequency matrix $A_I^{(2)}$ 421 of the second segment $X^{(2)}$ 420, and a time-related information matrix $S_I^{(2)}$ 424 corresponding to the frequency matrix $A_I^{(2)}$ 421.

The common component of the third segment $X^{(3)}$ 430 may be transformed to a dot product between the common frequency matrix $A_C$ 411 and a time-related information matrix $S_C^{(3)}$ 432 corresponding to the common frequency matrix $A_C$ 411. Additionally, the non-target sound source information included in only the third segment $X^{(3)}$ 430 may be transformed to a dot product between a unique frequency matrix $A_I^{(3)}$ 431 for the third segment $X^{(3)}$ 430, and a time-related information matrix $S_I^{(3)}$ 433 corresponding to the frequency matrix $A_I^{(3)}$ 431.

Figure 5:
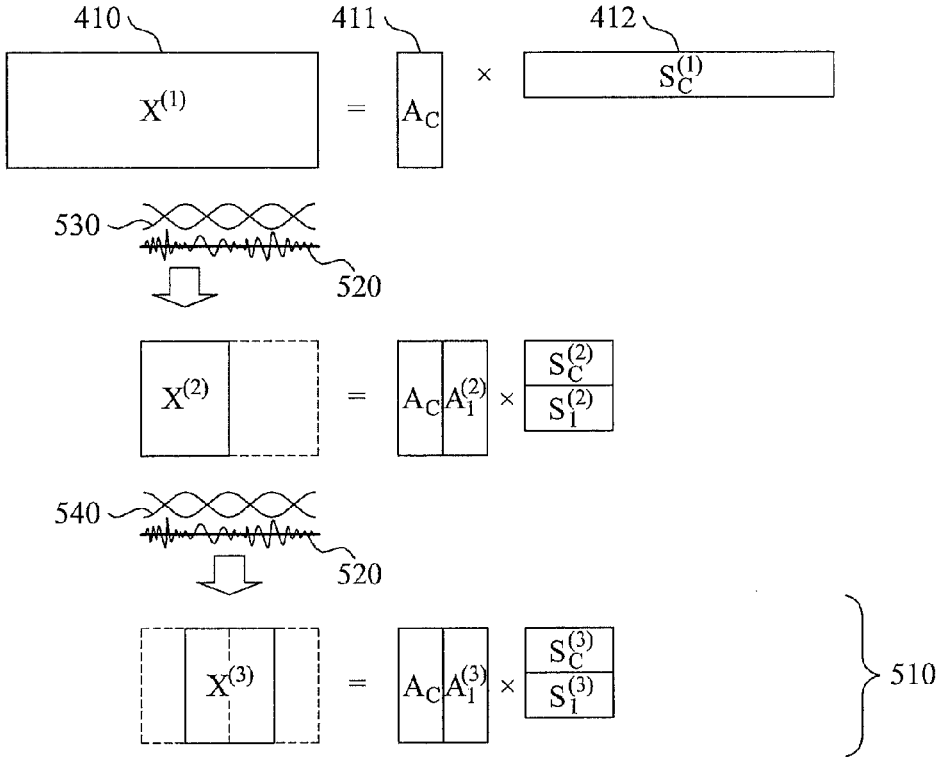
FIG. 5 illustrates a diagram of examples of segments input to the NMPCF analyzer when a window applying unit of the mixed signal divider is operated according to example embodiments.

FIG. 5 illustrates a diagram of examples of segments input to the NMPCF analyzer 130 when the window applying unit 320 is operated.

Here, the segment divider 310 may divide the mixed signal into segments, so that a front portion of a segment may overlap a rear portion of a previous segment, based on the overlapping operation through the window applying unit 320.

For example, when an 1-th segment is generated by dividing a time domain sample from "x(t+1)" to "x(t+2T)", the segment divider 310 may generate an (l+1)-th segment by dividing a time domain sample from "x(t+T+1)" to "x(t+3T)", and may enable the 1-th segment and the (l+1)-th segment to overlap each other in an area between "x(t+T+1)" and "x(t+2T)", as indicated by reference numeral 510 of FIG. 5.

In this example, a window 530 applied to an 1-th segment of an input mixed signal 520 in a time domain by the window applying unit 320 may have various forms. Additionally, a rear portion of an 1-th window (namely, a right portion of the i-th window), and a front portion of an (l+1)-th window (namely, a left portion of the (l+1)-th window) may be summed to obtain a value of "1".

Additionally, when the window applying unit 160 is additionally operated, an 1-th composite window may be generated by multiplying the 1-th window of the window applying unit 320 by an 1-th window of the window applying unit 160. Here, a sum of a rear portion of the 1-th composite window and a front portion of an (l+1)-th composite window may need to be "1".

Figure 6:
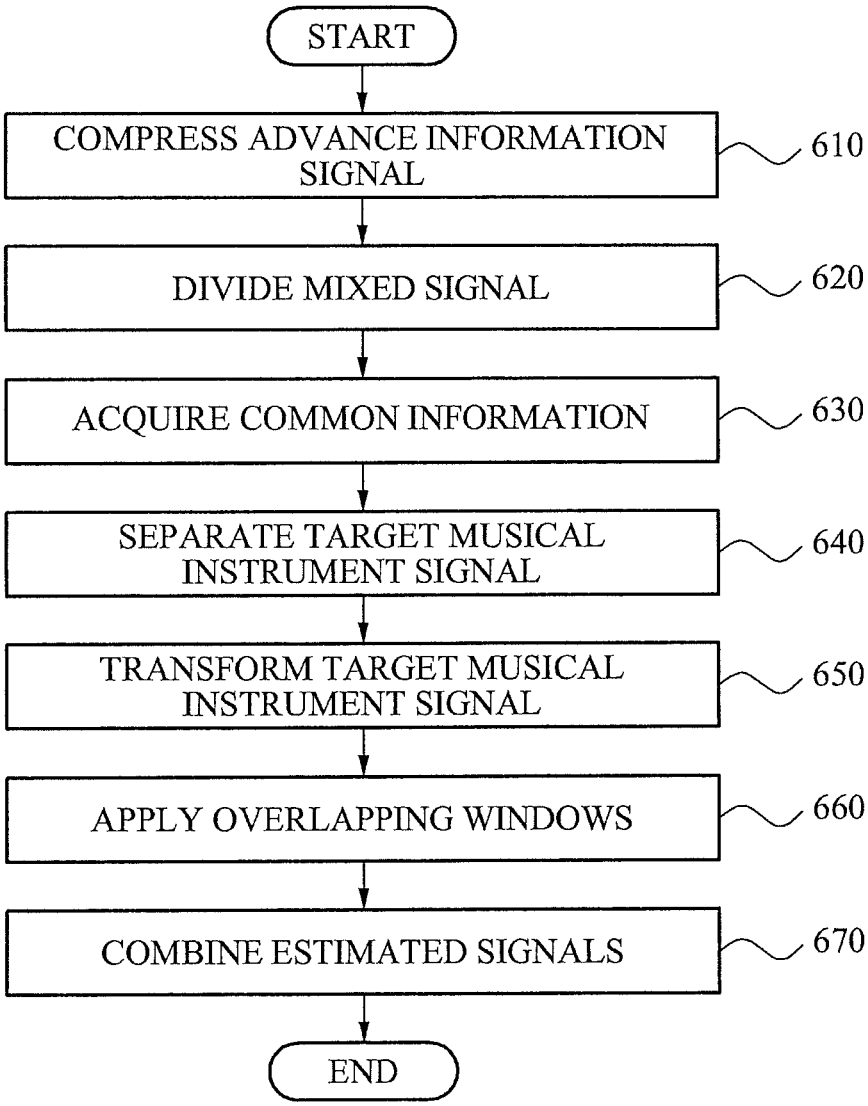
FIG. 6 illustrates a flowchart of a musical sound source separation method according to example embodiments.

FIG. 6 illustrates a flowchart of a musical sound source separation method according to example embodiments.

In operation 610, the prior information signal compressor 110 may compress an prior information signal including a characteristic of a predetermined sound source, and may provide the NMPCF analyzer 130 with the compressed prior information signal. Here, the prior information signal compressor 110 may compress the prior information signal, so that characteristics required to separate the predetermined sound source may remain even after compression.

In operation 620, the mixed signal divider 120 may divide a mixed signal including a plurality of sound sources into a plurality of segments. Here, when a target musical instrument signal separated by the target musical instrument signal separator 140 includes different error signals for each of the plurality of segments, the mixed signal divider 120 may apply overlapping windows to the plurality of segments, in order to prevent a user from feeling heterogeneity between the segments.

Here, operations 610 and 620 may be performed in parallel. Specifically, operation 620 may be performed prior to operation 610, or operations 610 and 620 may be simultaneously performed.

In operation 630, the NMPCF analyzer 130 may acquire common information by applying the NMPCF algorithm to the mixed signal divided in operation 620, and the prior information signal compressed in operation 610. The common information may be shared by the plurality of segments.

In operation 640, the target musical instrument signal separator 140 may separate the target musical instrument signal corresponding to the predetermined sound source from the mixed signal, based on the common information acquired in operation 630.

In operation 650, the time domain signal transformer 150 may transform the target musical instrument signal separated in operation 640 into a time domain signal, and may generate estimated signals for each of the segments. Here, the estimated signals may be obtained by separating the target musical instrument signal.

In operation 660, the window applying unit 160 may apply the overlapping windows to the estimated signals generated in operation 650. Here, the window applying unit 160 may correct different error signals for each of the segments by applying the overlapping windows to the estimated signals.

In operation 670, the signal combiner 170 may combine the estimated signals where the overlapping windows are applied in operation 660, and may generate a composite estimated signal.

According to example embodiments, when there is sound source information including only a predetermined sound source, a mixed signal may be reconfigured with a target sound source and other sound sources, by directly using the sound source information and, at the same time, by using a characteristic of a sound source that is periodically repeated, and thus it is possible to more efficiently separate the sound sources included in the mixed signal.

Additionally, according to example embodiments, it is possible to apply overlapping windows during separating of sound sources, thereby preventing a user from feeling heterogeneity between segments during playback of a target sound source, when the separated target sound source includes different error signals for each of the segments.

Although example embodiments have been shown and described, it would be appreciated by those skilled in the art that changes may be made in these example embodiments without departing from the principles and spirit of the disclosure, the scope of which is defined in the claims and their equivalents.

What is claimed is:

1. A musical sound source separation apparatus, comprising:

an prior information signal compressor to compress an prior information signal comprising a characteristic of a predetermined sound source;

a mixed signal divider to divide a mixed signal into a plurality of segments, the mixed signal comprising a plurality of sound sources;

a Nonnegative Matrix Partial Co-Factorization (NMPCF) analyzer to acquire common information by applying an NMPCF algorithm to the prior information signal, and the mixed signal, the common information being shared by the plurality of segments; and a target musical instrument signal separator to separate a target musical instrument signal corresponding to the predetermined sound source from the mixed signal, based on the common information.

2. The musical sound source separation apparatus of claim 1, wherein the prior information signal compressor comprises:

a time domain signal compressor to compress an prior information signal in a time domain;

a first time-frequency domain transformer to transform the compressed prior information signal in the time domain into an prior information signal in a time-frequency domain; and a time-frequency domain signal compressor to compress the prior information signal in the time-frequency domain, and to provide the NMPCF analyzer with the compressed prior information signal in the time-frequency domain.

3. The musical sound source separation apparatus of claim 1, wherein the mixed signal divider comprises:

a segment divider to divide the mixed signal into the plurality of segments; and a second time-frequency domain transformer to transform the mixed signal divided into the plurality of segments into a time-frequency domain signal, and to provide the NMPCF analyzer with the time-frequency domain signal.

4. The musical sound source separation apparatus of claim 3, wherein the mixed signal divider further comprises a first window applying unit to apply overlapping windows to the mixed signal divided into the plurality of segments.

5. The musical sound source separation apparatus of claim 4, wherein the segment divider divides the mixed signal into the plurality of segments so that the plurality of segments partially overlap each other.

6. The musical sound source separation apparatus of claim 5, wherein the first window applying unit selects forms of the overlapping windows, so that a sum of windows applied to an area where the plurality of segments partially overlap each other is "1".

7. The musical sound source separation apparatus of claim 1, further comprising:

a time domain signal transformer to transform the target musical instrument signal from a time-frequency domain to a time domain, and to generate estimated signals for each of the plurality of segments, the estimated signals being obtained by separating the target musical instrument signal; and a signal combiner to combine the estimated signals, and to generate a composite estimated signal.

8. The musical sound source separation apparatus of claim 7, further comprising:

a second window applying unit to apply overlapping windows to the estimated signals.

9. The musical sound source separation apparatus of claim 1, wherein the target musical instrument signal separator calculates a dot product between entity matrices corresponding to the common information, and separates the target musical instrument signal from the mixed signal.

10. A musical sound source separation method, comprising:

compressing an prior information signal comprising a characteristic of a predetermined sound source;

dividing a mixed signal into a plurality of segments, the mixed signal comprising a plurality of sound sources;

acquiring common information by applying a Nonnegative Matrix Partial Co-Factorization (NMPCF) algorithm to the prior information signal, and the mixed signal, the common information being shared by the plurality of segments; and separating a target musical instrument signal corresponding to the predetermined sound source from the mixed signal, based on the common information.

11. The musical sound source separation method of claim 10, wherein the compressing comprises:

compressing an prior information signal in a time domain;

transforming the compressed prior information signal in the time domain into an prior information signal in a time-frequency domain; and compressing the prior information signal in the time-frequency domain, wherein the acquiring comprises acquiring the common information based on the compressed prior information signal in the time-frequency domain.

12. The musical sound source separation method of claim 10, wherein the dividing comprises:

dividing the mixed signal into the plurality of segments; and transforming the mixed signal divided into the plurality of segments into a time-frequency domain signal, wherein the acquiring comprises acquiring the common information based on the transformed time-frequency domain signal.

13. The musical sound source separation method of claim 12, wherein the dividing further comprises applying overlapping windows to the mixed signal divided into the plurality of segments.

14. The musical sound source separation method of claim 13, wherein the dividing comprises dividing the mixed signal into the plurality of segments so that the plurality of segments partially overlap each other.

15. The musical sound source separation method of claim 14, wherein the applying comprises selecting forms of the overlapping windows, so that a sum of windows applied to an area where the plurality of segments partially overlap each other is "1".

16. The musical sound source separation method of claim 10, further comprising:

transforming the target musical instrument signal from a time-frequency domain to a time domain, and generating estimated signals for each of the plurality of segments, the estimated signals being obtained by separating the target musical instrument signal; and combining the estimated signals, and generating a composite estimated signal.

17. The musical sound source separation method of claim 16, further comprising:

applying overlapping windows to the estimated signals.

18. The musical sound source separation method of claim 10, wherein the separating comprises calculating a dot product between entity matrices corresponding to the common information, and separating the target musical instrument signal from the mixed signal.

* * * * *